US005595442A

United States Patent [19]

Glass et al.

[11] Patent Number: 5,595,442

[45] Date of Patent: Jan. 21, 1997

[54] TUMBLER LOADER ASSEMBLY

[75] Inventors: Gerald E. Glass, Springfield; Lindy L. May, Strafford; Robert C. Norton, Jr., Nixa, all of Mo.

[73] Assignee: Custom Metalcraft, Inc., Springfield, Mo.

[21] Appl. No.: 268,793

[22] Filed: Jun. 30, 1994

[51] Int. Cl.[6] ..... B01F 11/00

[52] U.S. Cl. ..... 366/213; 414/391; 414/399; 414/529

[58] Field of Search ..... 414/390, 391, 414/399, 401, 529, 530, 531, 532, 533, 534, 535, 536, 584; 366/208, 209, 213, 214

[56] References Cited

U.S. PATENT DOCUMENTS

| | | | |
|---|---|---|---|
| 2,840,219 | 6/1958 | Mervyn et al. . | |
| 3,746,148 | 7/1973 | Hilger et al. . | |
| 3,863,890 | 2/1975 | Ruffing . | |
| 4,089,100 | 5/1978 | Berry, Jr. . | |
| 4,120,411 | 10/1978 | Johnson | 414/401 |
| 4,195,963 | 4/1980 | Leukoff et al. | 414/391 |
| 4,715,766 | 12/1987 | Gebhardt | 414/399 |
| 4,746,258 | 5/1988 | Loomer et al. | 414/584 |
| 5,048,972 | 9/1991 | Wiese . | |
| 5,108,190 | 4/1992 | Benthimer et al. . | |
| 5,116,134 | 5/1992 | Edwards et al. | 366/208 |
| 5,320,475 | 6/1994 | Pinder | 414/529 |

FOREIGN PATENT DOCUMENTS

| | | | |
|---|---|---|---|
| 147520 | 6/1990 | Japan | 414/391 |

*Primary Examiner*—Thomas J. Brahan
*Attorney, Agent, or Firm*—Nies, Kurz, Bergert & Tamburro

[57] ABSTRACT

A tumbler loader assembly is capable of moving a container to be tumbled from a conveyor loading area into a tumbler device using a feed cart while maintaining a low cart profile. The feed cart is capable of moving the container on conveyor rollers along the feed cart as well as having the capability for movement along a guide rail from a first position where the container is loaded onto the feed cart to a second position interior of the tumbler. The tumbler device has raising and lowering capability for interengaging the feed cart as well as for positioning the container for proper tumbling. Upon loading of the container onto the feed cart, the feed cart moves along the guide rail into the tumbler. The tumbler lowers to interengage the feed cart. The feed cart then transfers the container into the tumbler and the tumbler raises to allow the feed cart to return to its starting position. The tumbler then vertically adjusts the container for proper balancing, clamps the container, and carries out the tumbling cycle. The procedure may then be reversed to remove the container from the tumbler and transfer the container back to the conveyor.

5 Claims, 13 Drawing Sheets

TUMBLER LOADER ASSEMBLY

BACKGROUND AND SUMMARY OF THE INVENTION

The present invention relates to apparatus for loading and unloading a container from a tumbler by mechanical means. More particularly, the present invention relates to an apparatus for vertical and horizontal movement of a tumbler device allowing the tumbling cycle to be carried out in a smooth operation along with loading and unloading of the tumbler along a low profile.

Previous apparatus for use in loading and unloading of mechanical equipment are described in the following U.S. Pat. Nos.: 2,840,219 to Mervyn et al.; 3,746,148 to Hilger et al.; 3,863,890 to Ruffing; 4,089,100 to Berry; 5,048,972 to Wiese; and 5,108,190 to Benthimer et al.

By the present invention, there is provided a tumbler loader assembly which allows the loading and unloading of a container or bin from a tumbler by the use of mechanical equipment including a transfer conveyor, a conveyor feed cart and a tumbler device.

The present invention provides for a bin to be received from a transfer conveyor onto a conveyor feed cart. The feed cart moves the bin into the tumbler while maintaining a low profile. The bin is then positioned for tumbling by the tumbler. The tumbler clamps the bin securely and begins the tumbling cycle. When the tumbling cycle is complete, the tumbler stops with the bin in the upright position. The bin is then unclamped, returned back onto the conveyor feed cart and loaded back onto the transfer conveyor.

DESCRIPTION OF THE PREFERRED EMBODIMENTS

Figure 1:
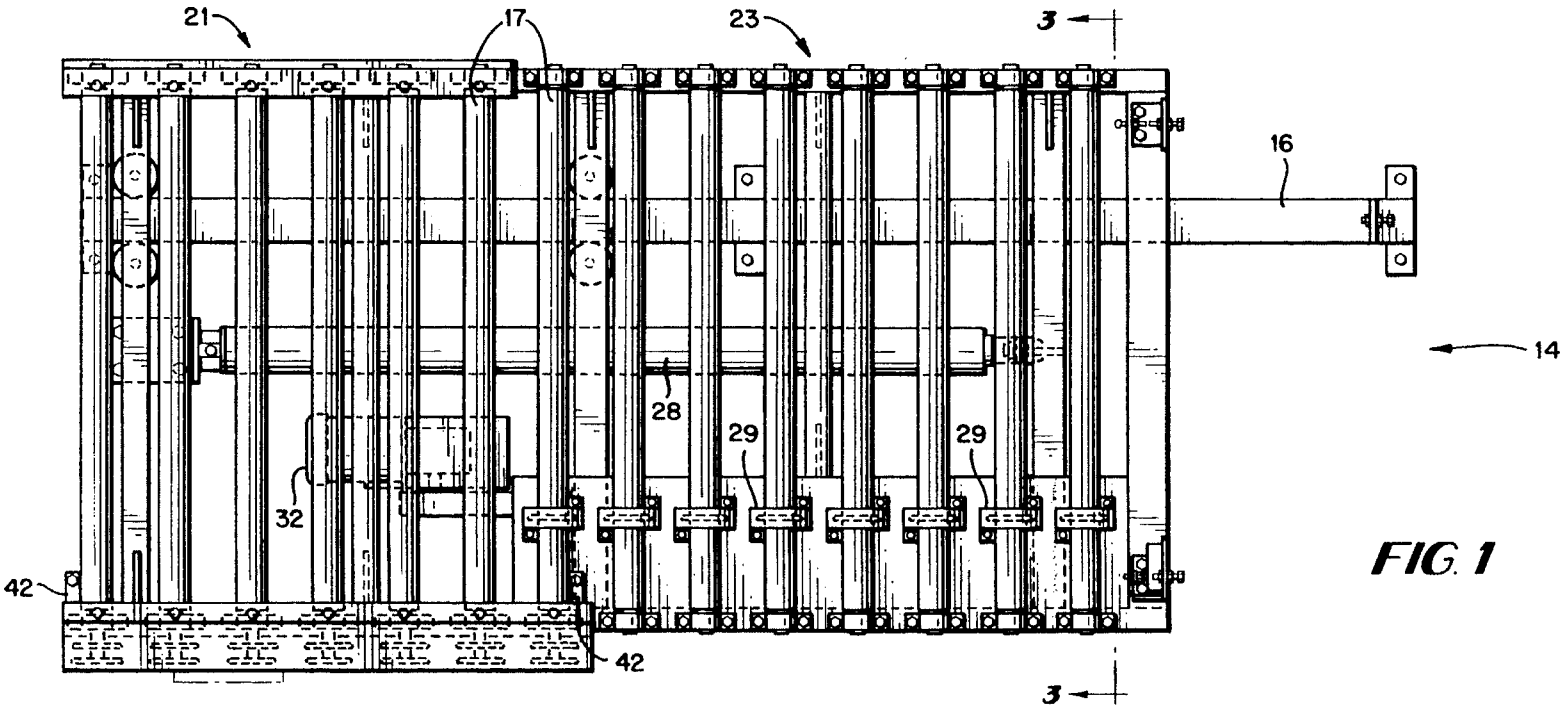
FIG. 1 is a plan view of the conveyor feed cart employed with the tumbler loader assembly of the present invention.
Figure 2:
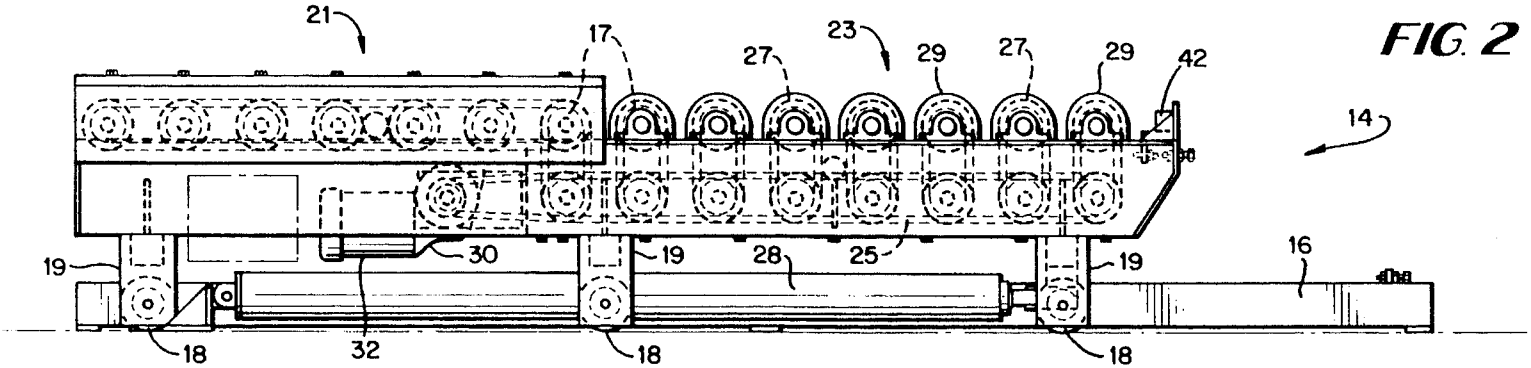
FIG. 2 is a side view of the feed cart of FIG. 1.
Figure 3:
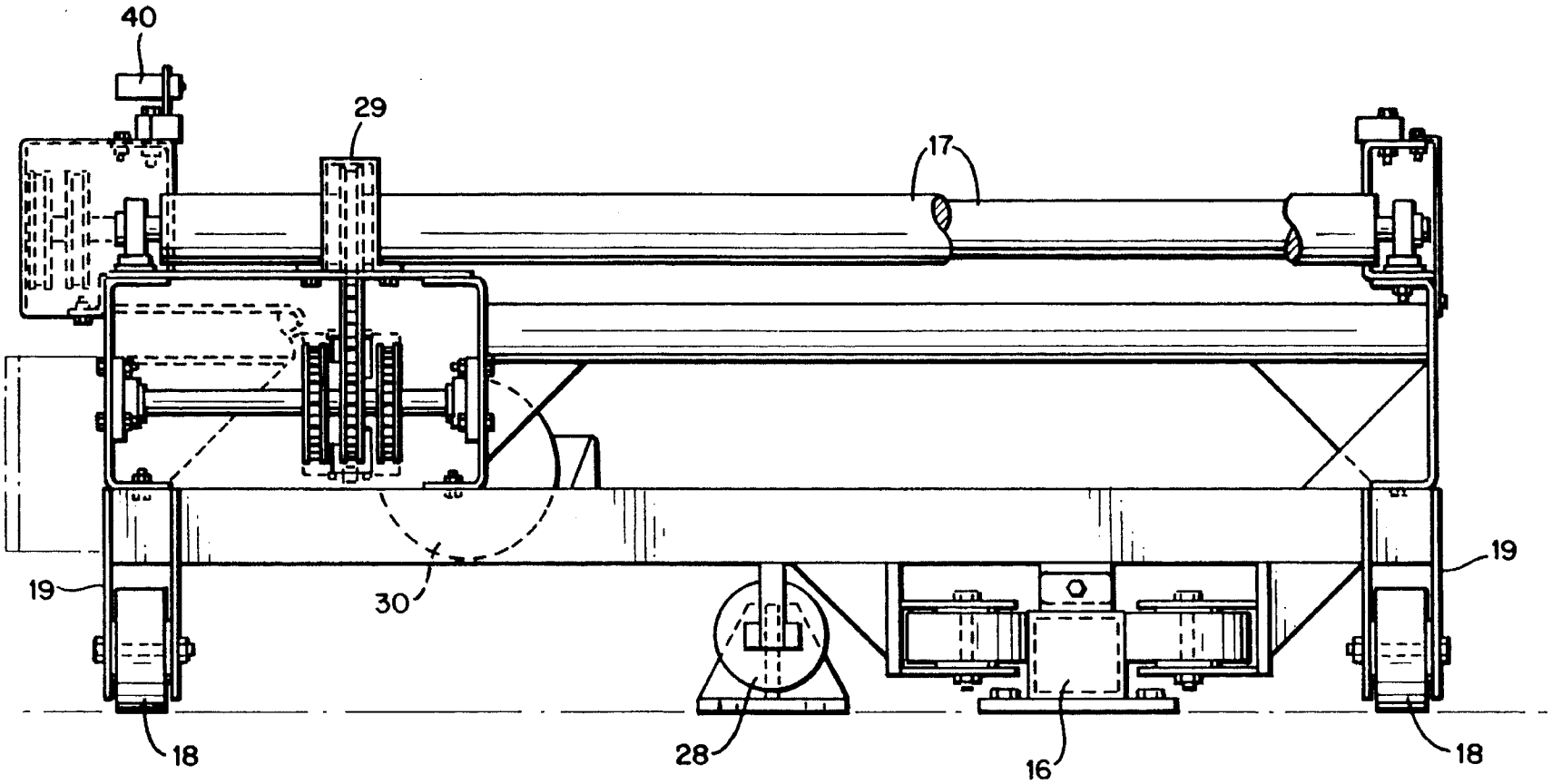
FIG. 3 is a cross-section of the feed cart taken along line 3—3 of FIG. 1.

In the embodiment of the present invention as shown in FIGS. 1 through 7, there is provided a tumbler loader assembly 10 which includes a tumbler 20 and a roller conveyor feed cart 14. The feed cart 14 is provided with rollers 17 for transferring a bin from a feed cart loading end 21 to a feed cart engaging end 23. A motor 32 is used to drive the rollers 17, by the use of chain drives 25, 27, with the upper chains 27 being covered by chain guards 29. The feed cart 14 is mounted on a cart guide rail 16 and has wheels 18 mounted in lower frame members 19 for movement from (a) a position for loading of a bin from a fork lift or transfer conveyor adjacent the feed cart loading end 21 to (b) a position within the tumbler 20. The cart guide rail 16 is a single square tube mounted to the floor which allows for angular positioning and side to side adjustment of the feed cart 14 as well as providing an end stop position for the feed cart 14.

The tumbler loader assembly 10 is also provided with a horizontal pneumatic cylinder 28 for positioning the feed cart 14 along the guide rail 16. In one embodiment, the pneumatic system for operating cylinder 28 includes a valve which is a three position, five port valve having blocked center ports which allows the cart to stop mid-stroke for emergency situations. The cylinder 28 is mounted in the floor and is capable of extending and retracting a piston member so as to move the feed cart 14 on its wheels 18 toward and away from the tumbler 20, respectively. The cylinder 28 is located beneath the rollers 17 of the feed cart 14 and does not extend beyond the tumbler 20.

Figure 4:
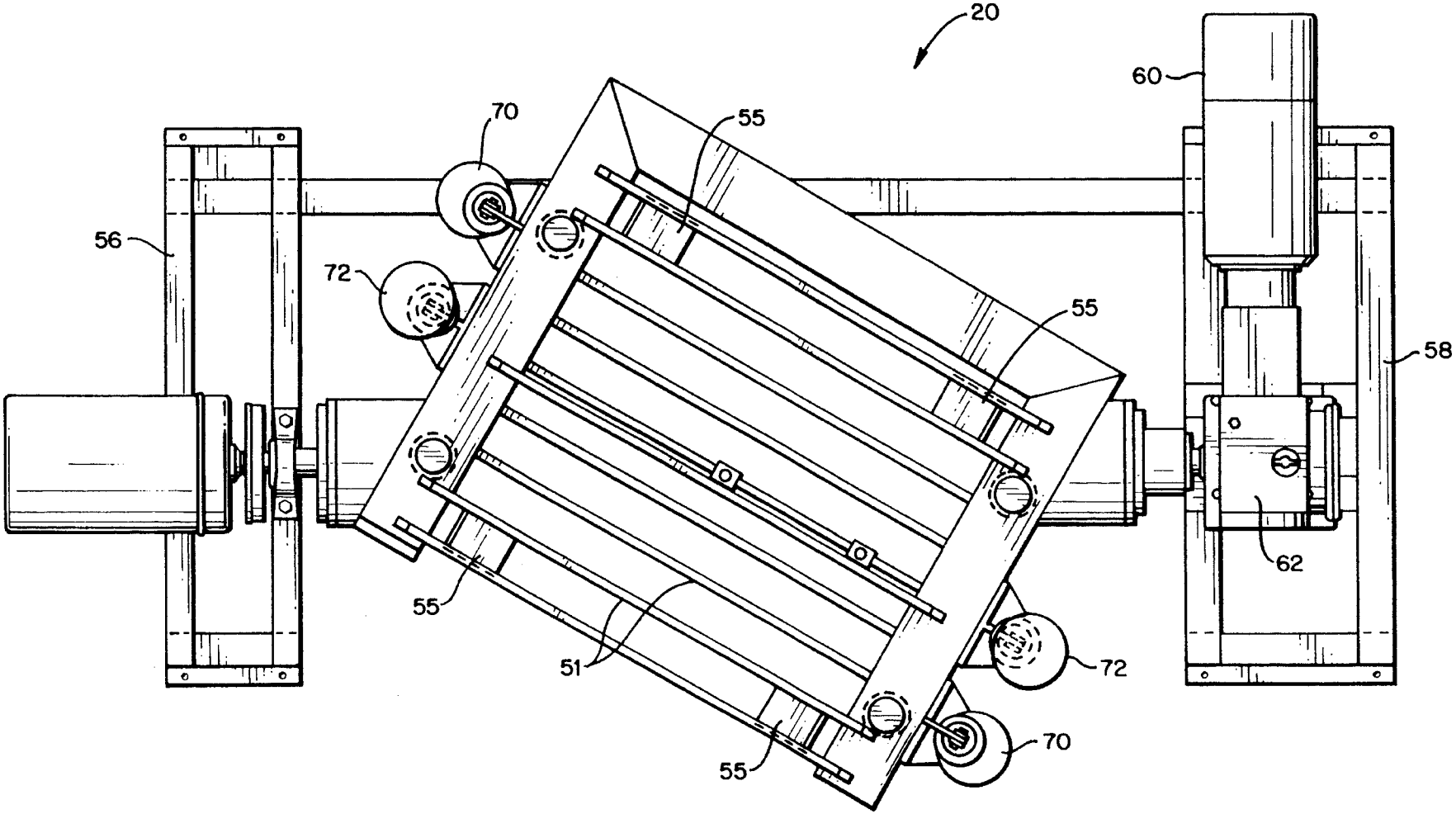
FIG. 4 is a plan view of the tumbler employed in the tumbler loader assembly of the present invention.
Figure 5:
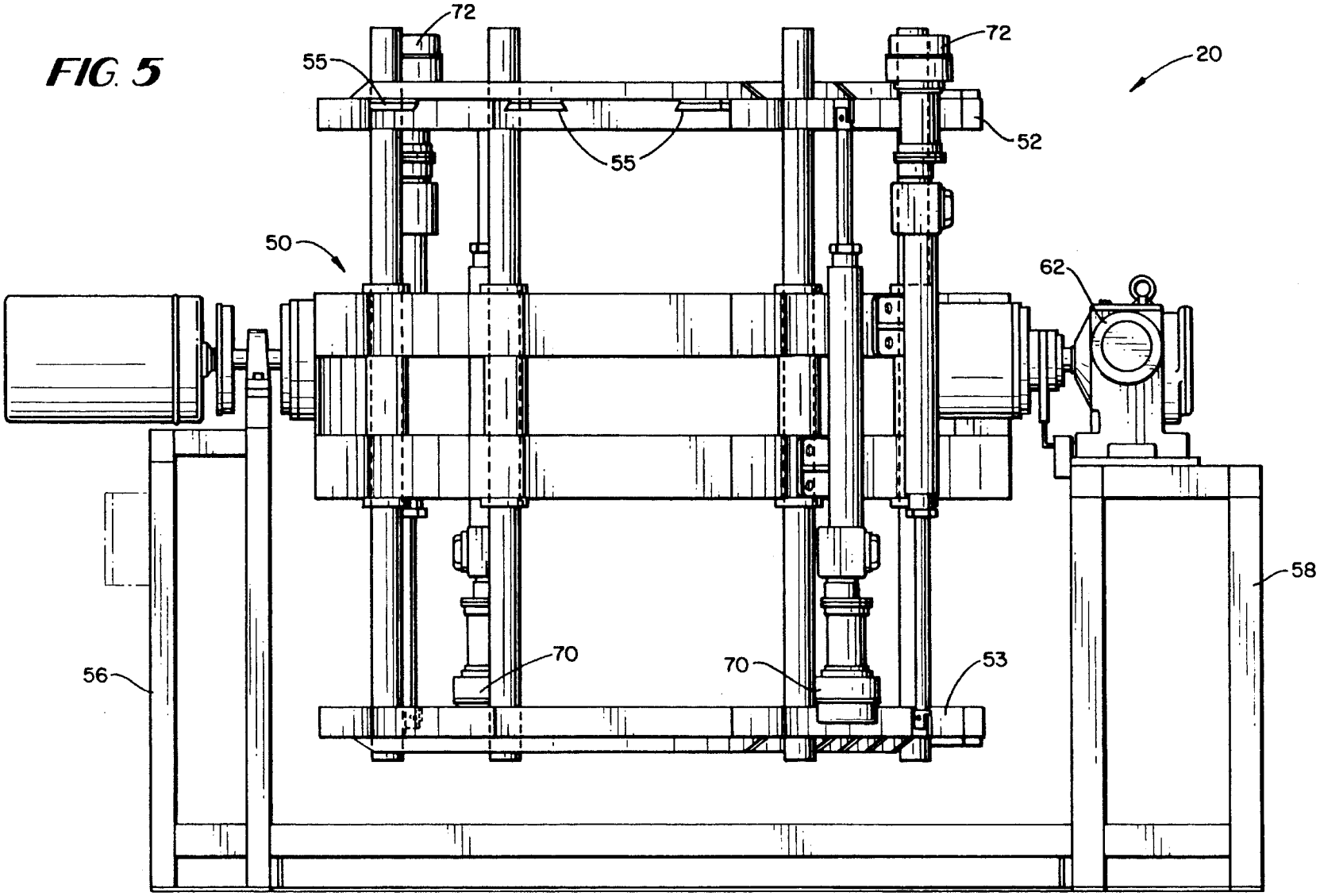
FIG. 5 is a front view of the tumbler of FIG. 4.
Figure 6:
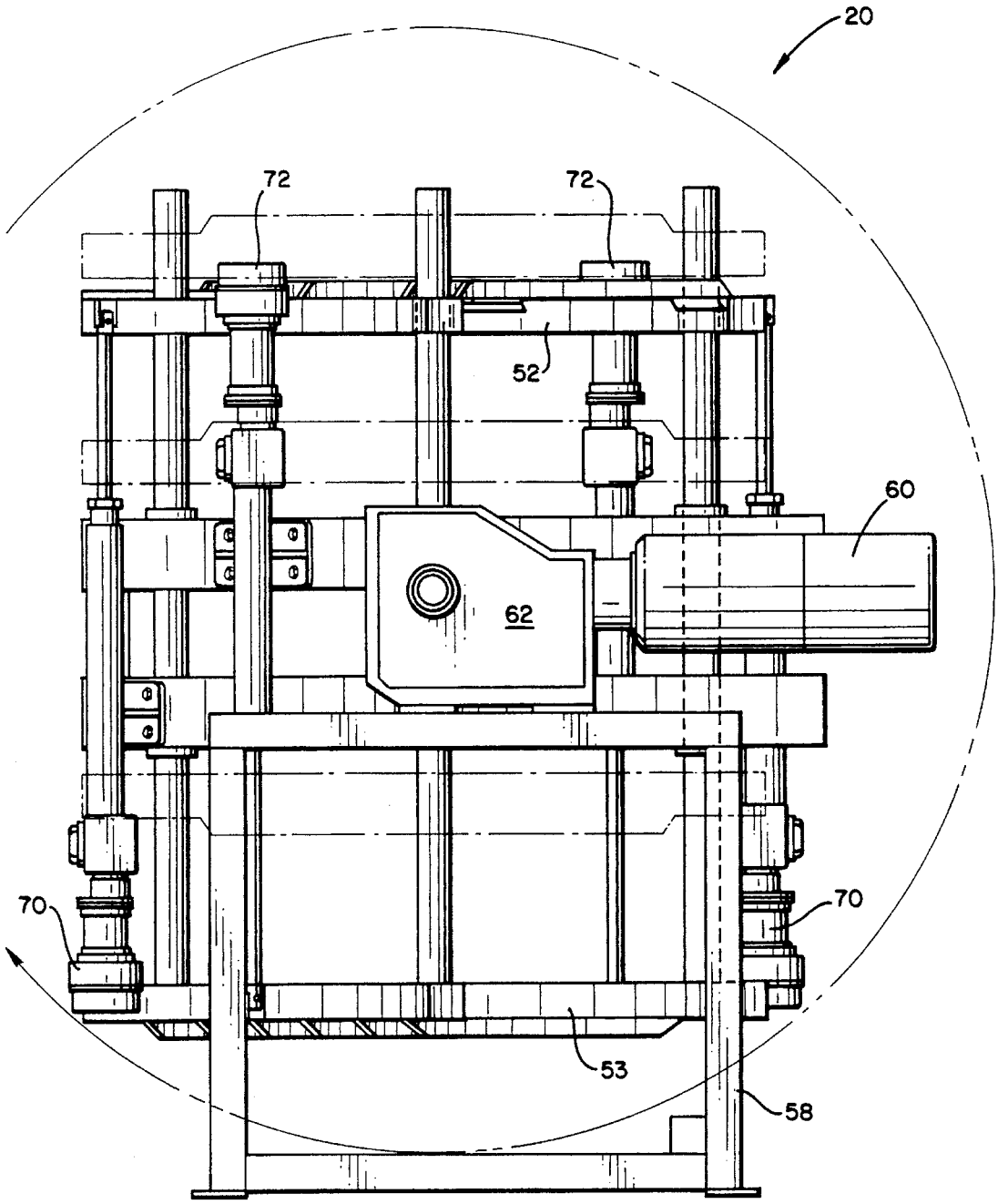
FIG. 6 is a side view of the tumbler of FIG. 4 with an arrow indicating the direction of the tumble cycle.
Figure 7:
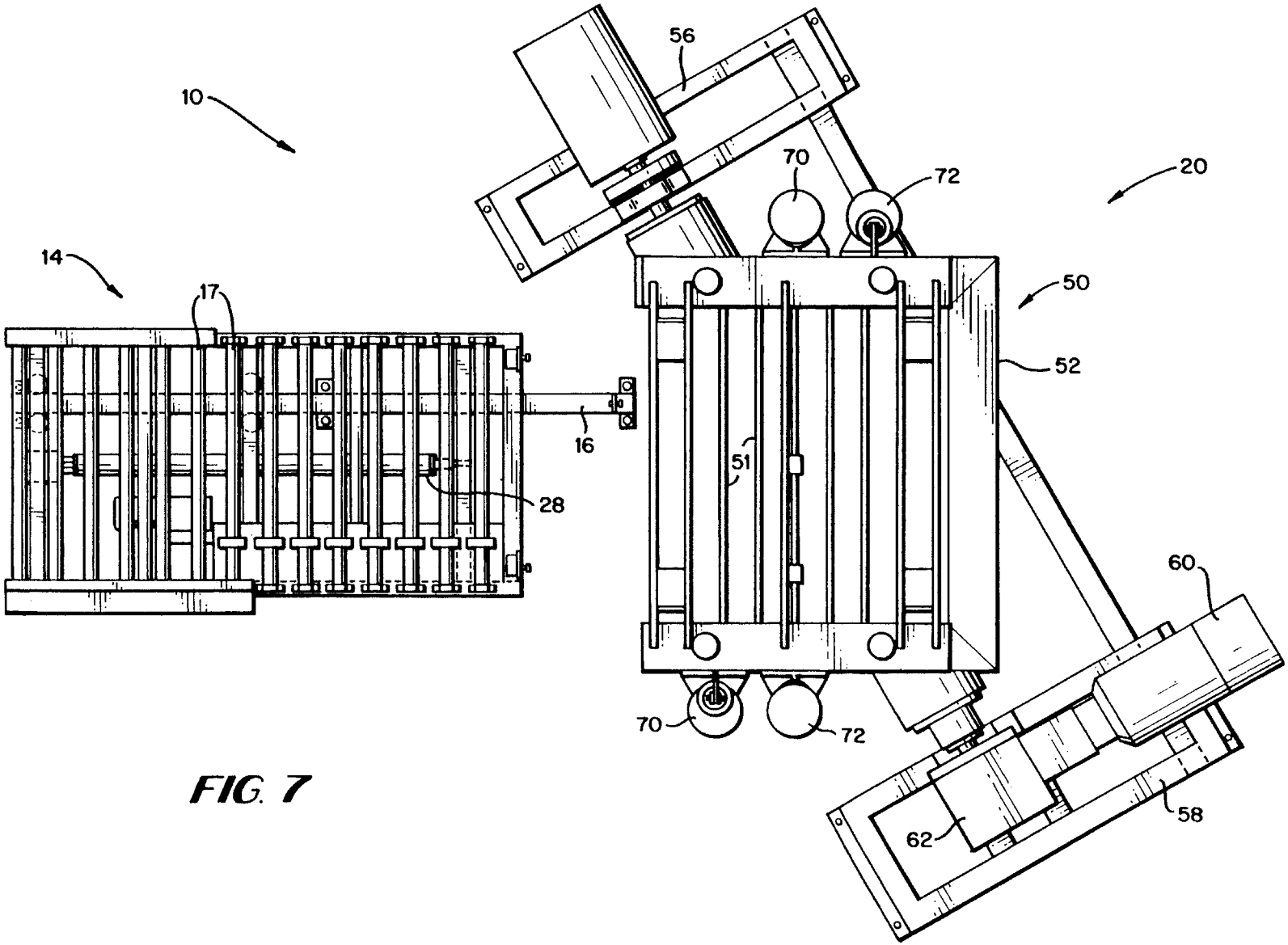
FIG. 7 is a plan view of the tumbler loader assembly of the present invention.

The tumbler 20 may be any conventional tumbler apparatus such as that shown in FIGS. 4 through 6, having a cradle 50 with upper 52 and lower 53 clamp frame assemblies and two pairs of linear screw actuators 70, 72 for clamping the bin securely in the cradle 50. Cradle 50 has cross members 51 in the lower clamp frame assembly 53 to increase its structural integrity. Cross members 51 are capable of interengaging the rollers 17 on the feed cart engaging end 23 when the feed cart 14 is in the previously mentioned position (b) within the tumbler 20 and the lower clamp frame assembly 53 is lowered. Tumbler lower clamp frame assembly 53 lowers and raises to engage the feed cart 14 and handle the bin, thus permitting a low feed cart profile for areas with a restrictive ceiling height. Also, clamp frame assembly 52 incorporates leg cups 55 for positive clamping and holding. Equipment for operating the tumbler 20 includes the support frame assembly 56, 58, the drive motor 60, and the direct drive gear reducer 62. The positioning of the feed cart 14 with respect to the tumbler 20 is shown in FIG. 7.

A tumbler unit may be employed having an automatic cycle such as the following:

(a) clamping the bin in place and verifying the placement of clamp, bin cover, and vent cap, such as by using proximity switches;

(b) accelerating and tumbling the bin for a pre-set amount of time;

(c) decelerating and stopping the bin in an upright position; and (d) unclamping the bin, thus completing the cycle.

Figure 8:
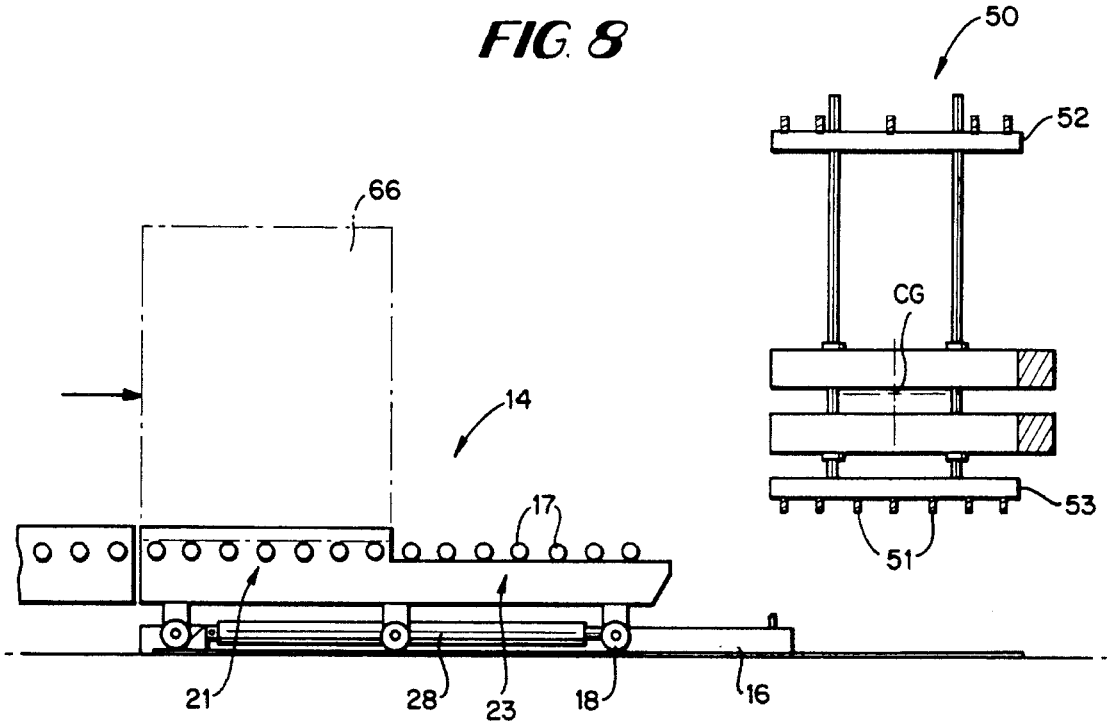
FIGS. 8 through 20 are schematic representations of the tumbler loader assembly showing the process of loading, tumbling, and unloading a bin, with the bin shown in phantom.

In the operation of the system of the present invention as shown in FIGS. 8 through 20, a bin 66 to be tumbled is transferred in the normal vertical position from a fork lift or transfer conveyor onto the conveyor feed cart 14 which may be at a height such as about 20 to 21 inches above the floor. The legs of the bin 66 will rest on the rollers 17 of the feed cart 14. Roller drive 30 is then energized by the motor 32 to transfer the bin 66 completely onto the loading end 21 of the feed cart 14, as shown in FIG. 8. The location of the bin 66 is confirmed by a proximity sensor such as a photo eye, indicated schematically at 40 in FIG. 3, which directs a beam of light for reflection by a bin.

Figure 9:
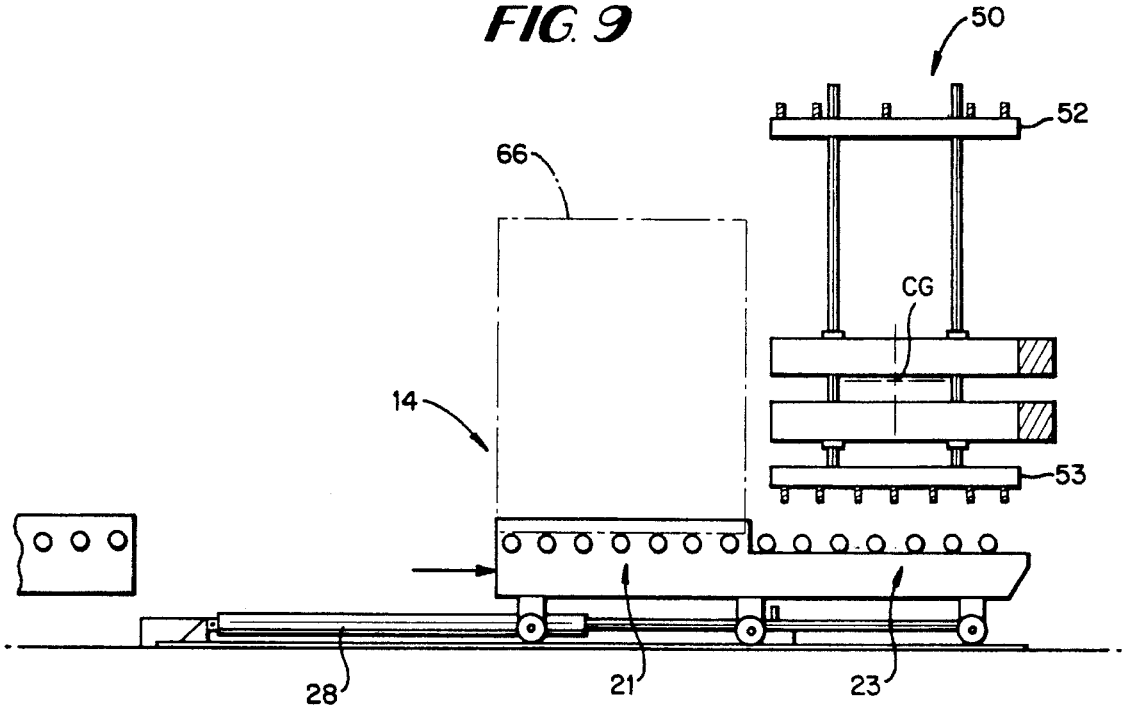
Figure 10:
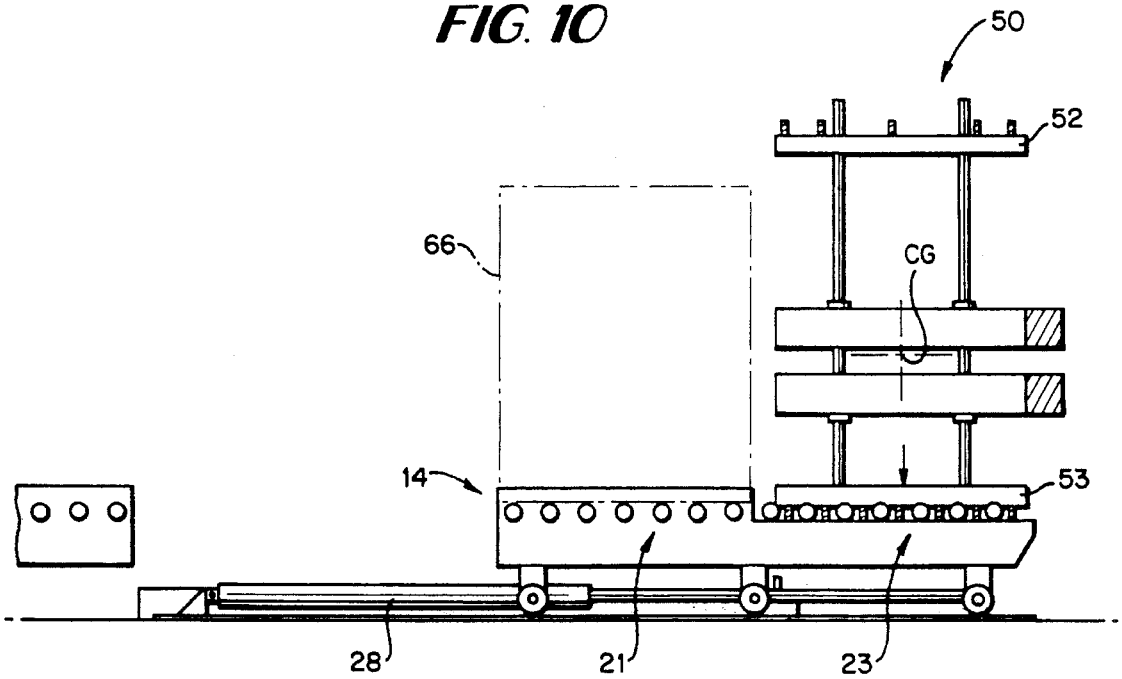

The feed cart 14 is then moved along the guide rail 16 toward the tumbler 20 by extension of the pneumatic cylinder 28. As the feed cart 14 enters the tumbler 20, the tumbler lower clamp frame assembly 53 is in the raised position as shown in FIG. 9. The feed cart position can be indicated by a proximity sensor. Once the feed cart engaging end 23 is located directly under the tumbler cradle 50, as shown in FIG. 9, the lower clamp frame assembly 53 is lowered to its lower limit by means of the linear actuators 70, 72 where it rests inside the feed cart engaging end 23, as shown in FIG. 10. The position of the lower clamp frame assembly 53 can be indicated by a position switch on the feed cart 14.

Figure 11:
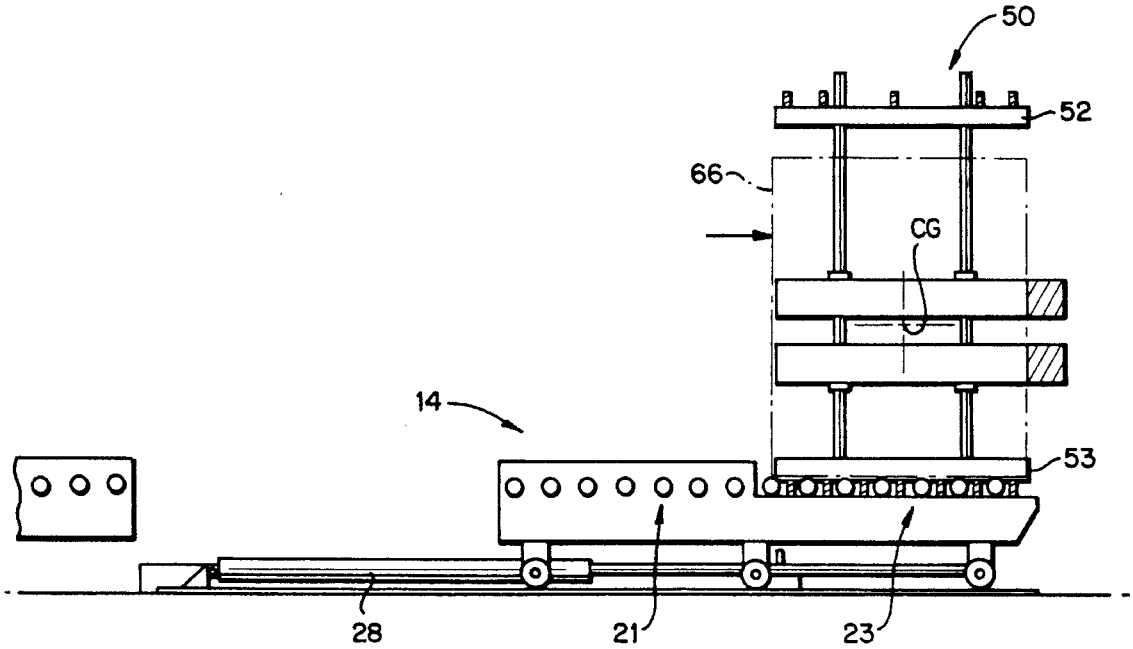
Figure 12:
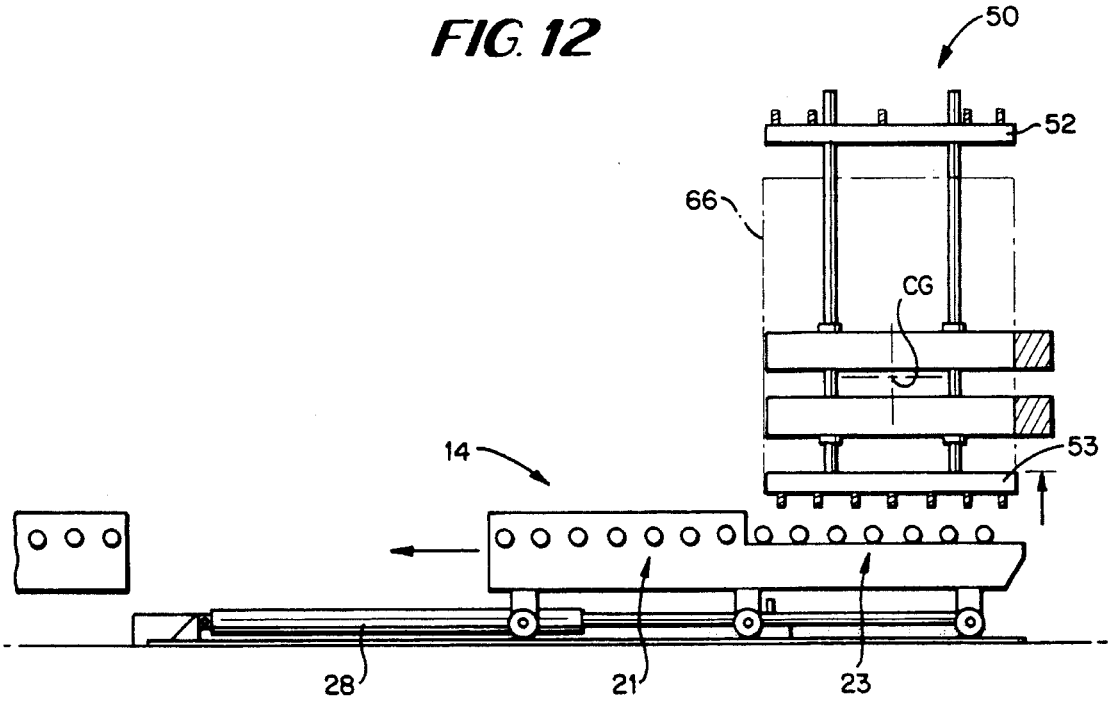
Figure 13:
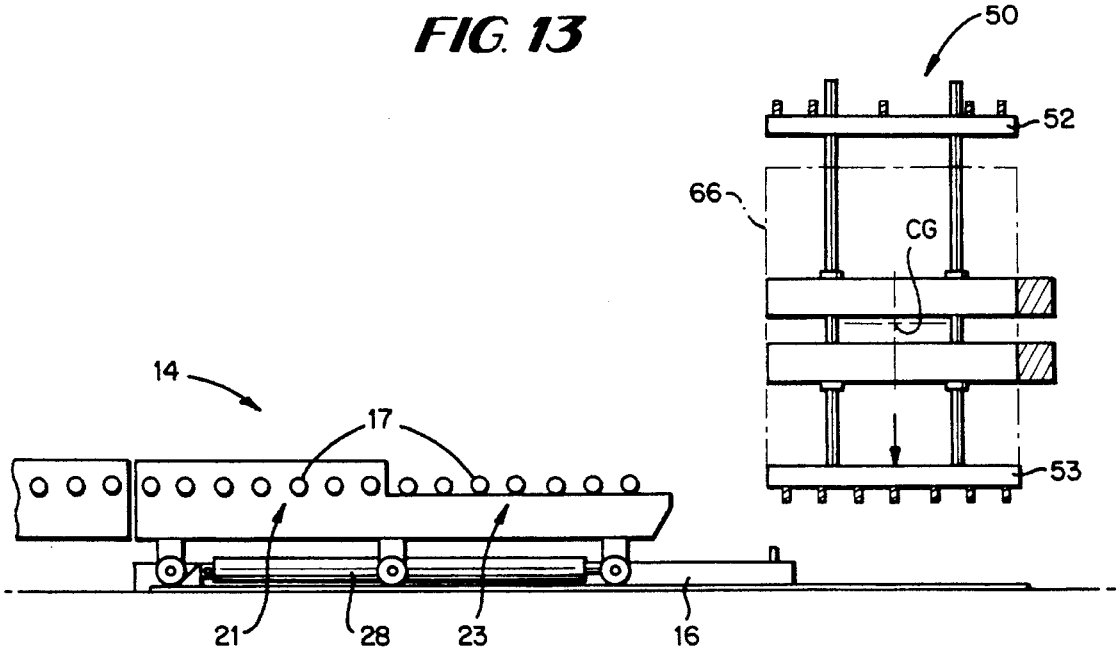

Next, the roller drive 30 is again energized to advance the bin into the tumbler cradle assembly 50, as shown in FIG. 11, where the bin's position can be indicated by a proximity sensor. The tumbler lower clamp frame assembly 53 then lifts the bin off the feed cart 14 as shown in FIG. 12. The position of the tumbler lower clamp frame assembly 53 can be indicated by a timer in the controls. With the bin lifted, the feed cart 14 can be returned to its starting position, also shown in FIG. 12, with cylinder 28 retracted. A proximity sensor again can indicate the position of the feed cart 14. As shown in FIG. 13, the lower clamp frame assembly 53 is capable of raising a pre-determined distance, depending on the size of the bin, in order to position the center of gravity of the bin at the center of rotation of the tumble cycle. A timer in the controls may be used to indicate the bin position. The largest bins will not cause the lower cradle assembly 50 to be raised.

Figure 14:
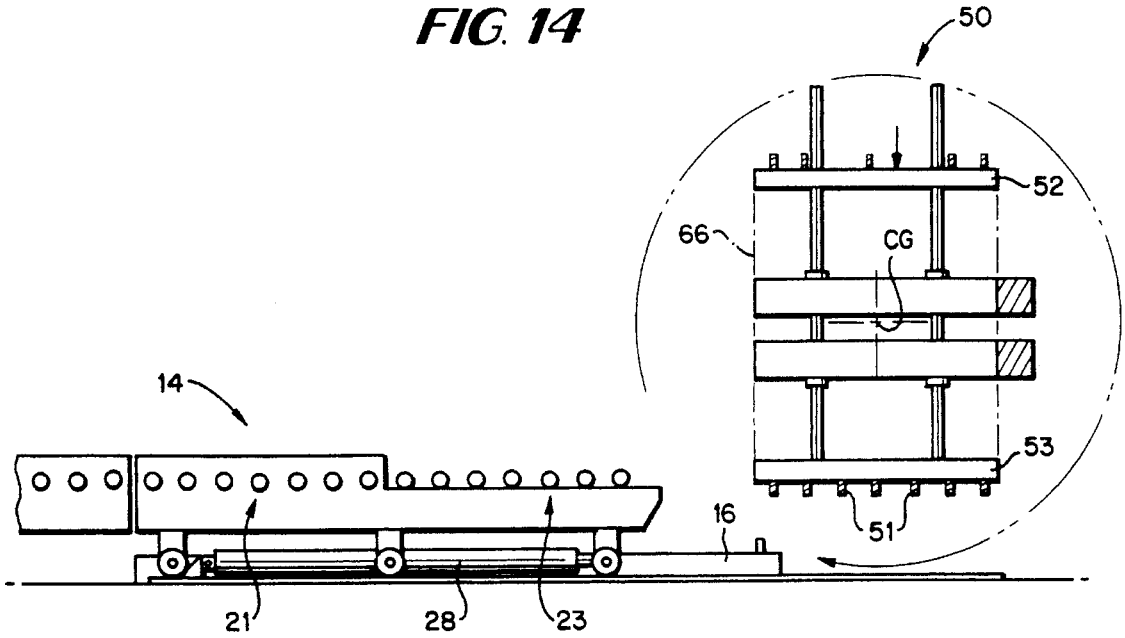

The upper clamp frame assembly 52 then securely clamps the bin for tumbling with the clamp frame assembly positions being indicated by thrust switches in the actuators. In FIG. 14, there is shown a bin 66 in position within the cradle 50 of the tumbler 20 with the clamp frame assemblies 52, 53 in the clamped position so that the bin is ready for the tumbling operation.

The tumbler 20 rotates the bin 66 for a predetermined amount of time. In one embodiment of the invention, the last revolution of the tumble cycle is at a slower speed and the bin 66 is rotated approximately 30° past vertical in order to level the product in the bin 66. The cradle 50 then reverses at a very slow speed to bring the cradle 50 back to a vertical position and stop. The cradle positions can be indicated by limit switches.

Figure 15:
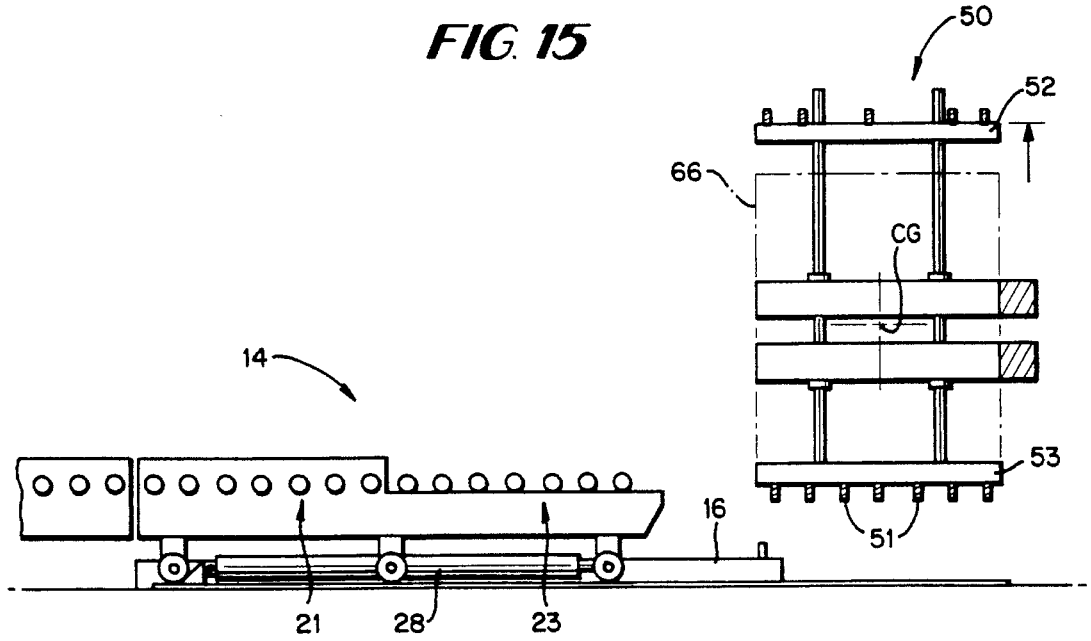
Figure 16:
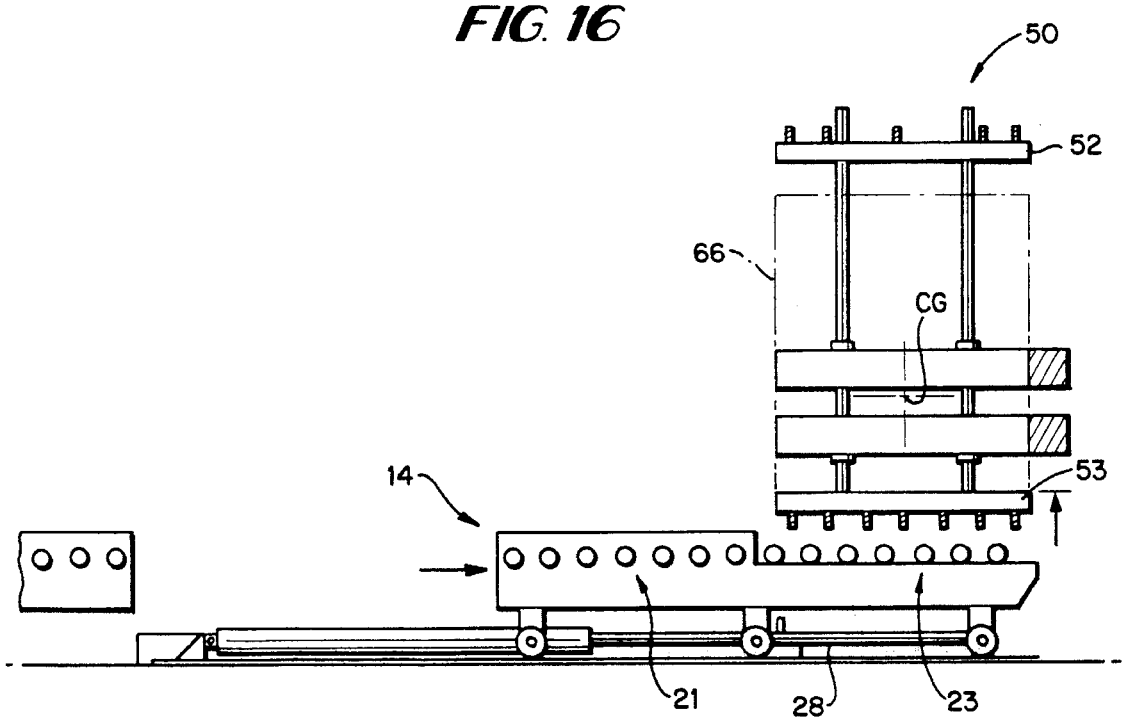
Figure 17:
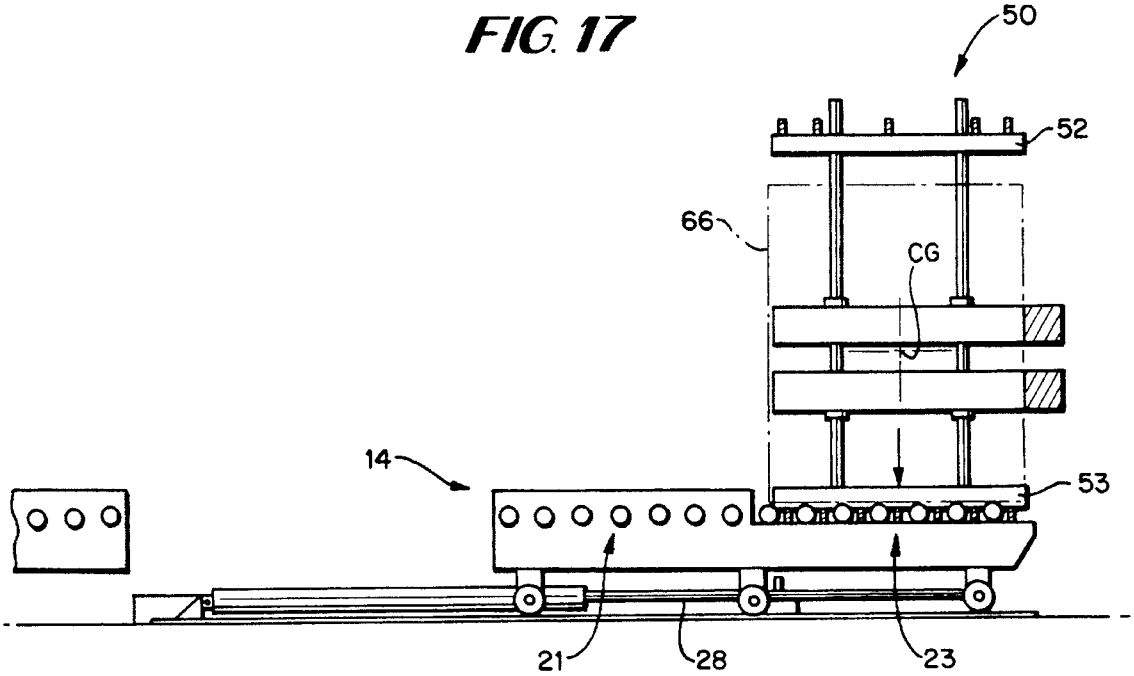
Figure 18:
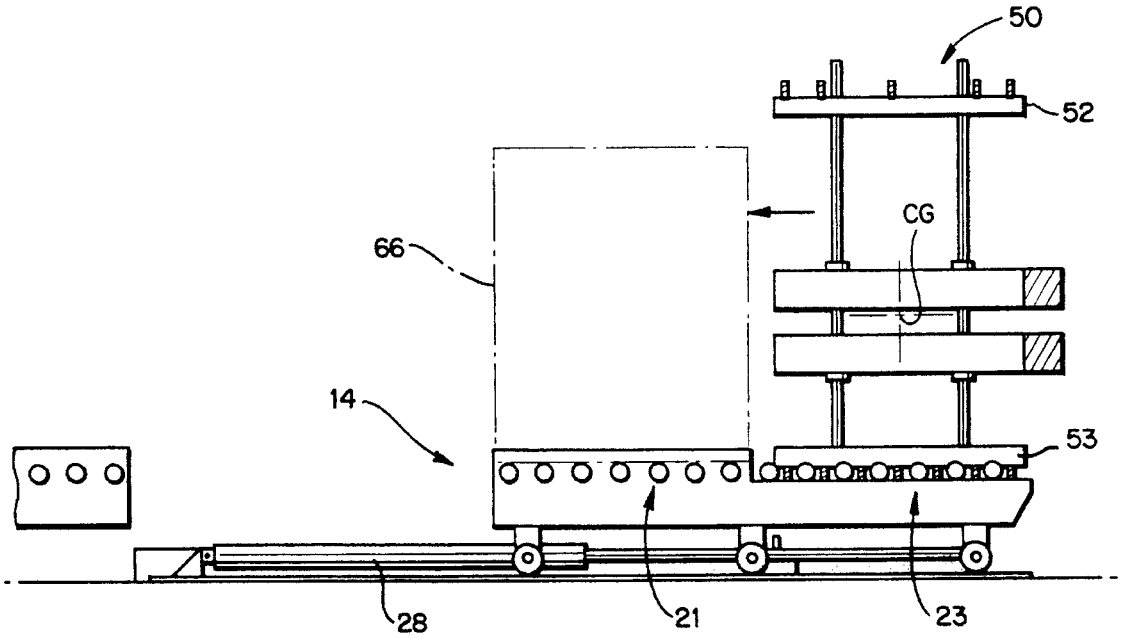
Figure 19:
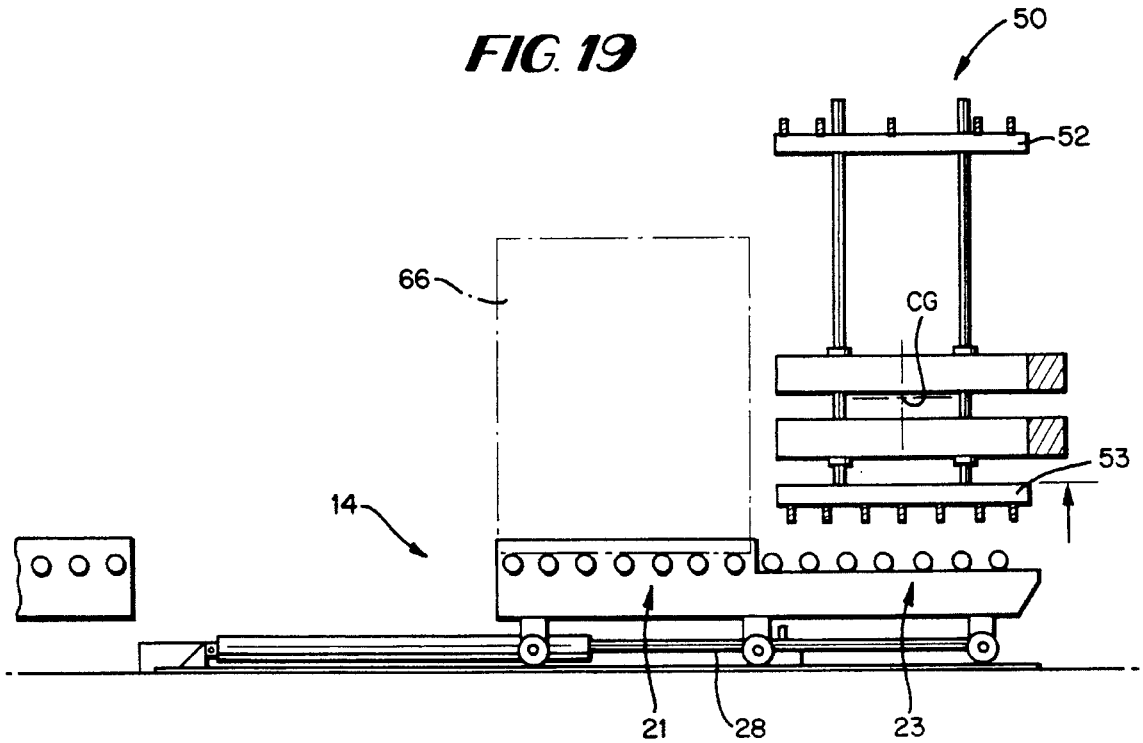
Figure 20:
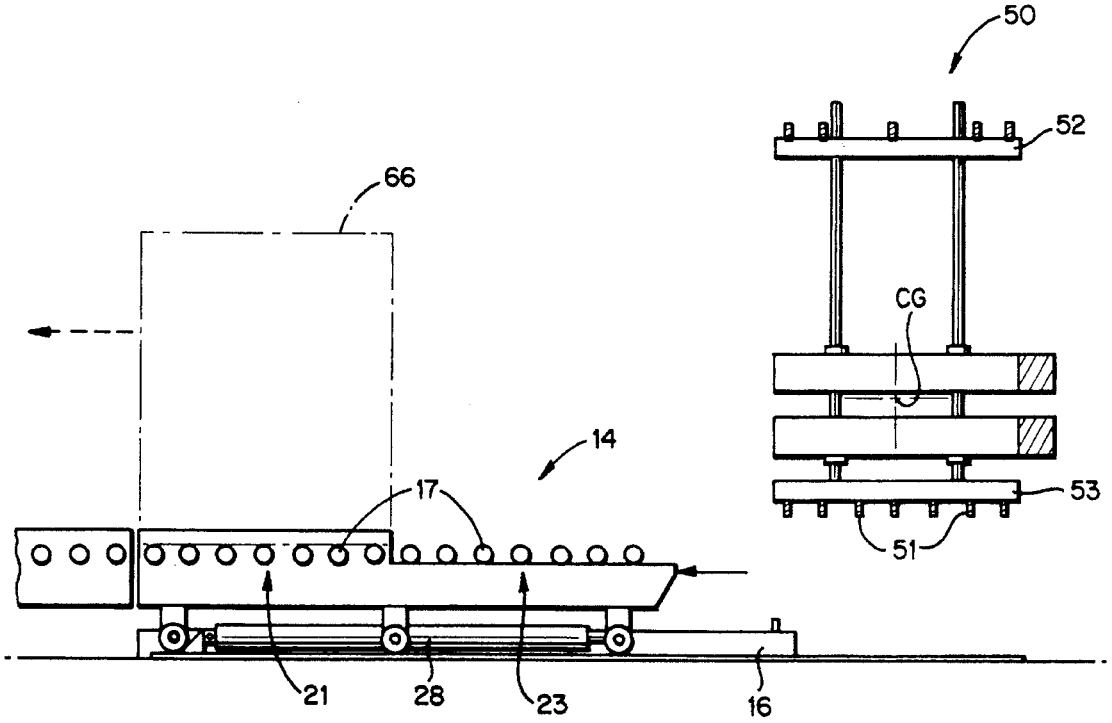

Once the tumbling is complete, the above procedure is reversed for unloading the bin as illustrated in FIGS. 15 through 20. FIG. 15 shows the upper clamp frame assembly 52 unclamping from the bin 66. FIG. 16 shows the lower clamp frame assembly 53 raising the bin 66 so as to allow the feed cart 14 to move back under the bin 66. FIG. 17 shows the lower clamp frame assembly 53 lowering the bin 66 onto the feed cart engaging end 23. The bin 66 is then rotated onto the loading end 21 of the feed cart 14 and the lower clamp frame assembly 53 then raises to disengage the feed cart 14, as shown in FIGS. 18 and 19. As shown in FIG. 20, the feed cart 14 is then retracted back to its original position by the pneumatic cylinder 28 and the bin 66 can then be moved off the feed cart 14.

In one embodiment, the assembly 10 of the present invention was employed to load and tumble a container having base dimensions of 51 inches by 51 inches, with an overall height of 81 inches and a maximum product load of 4,000 lbs. The tumbling speed was approximately 0 to 22 rpm.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A tumbler loader assembly for tumbling a bin or other container, comprising:

a feed cart having horizontally disposed conveyor rollers for transferring said bin along said feed cart;

means for operating said rollers;

means for tumbling said bin, said tumbling means including a cradle having cross members; and means for lateral movement of said feed cart between a first loading position exterior to said tumbling means and a second loading position interior of said tumbling means wherein at said second loading position said feed cart rollers are capable of interengaging said cradle cross members and transferring said bin into and out of said cradle.

2. The tumbler loader assembly of claim 1 wherein said feed cart has a loading end and an engaging end and wherein said roller operating means is employed to transfer said bin between said loading end and said engaging end.

3. The tumbler loader assembly of claim 1 wherein said cradle is provided with a lower clamp frame assembly and includes means for raising and lowering said lower clamp frame assembly for engaging said feed cart and for positioning said bin within said cradle.

4. The tumbler loader assembly of claim 3 wherein said cradle is also provided with an upper clamp frame assembly and includes means for raising and lowering said upper clamp frame assembly for positioning said bin within said cradle.

5. The tumbler loader assembly of claim 1 wherein said lateral movement means includes a pneumatic cylinder attached to and positioned underneath said feed cart and being capable of extending and retracting to move said feed cart between said first and second loading positions along a guide rail and further including means for mounting said feed cart for movement along said guide rail.

* * * * *